United States Patent [19]

Ishii et al.

[11] Patent Number: 4,593,619

[45] Date of Patent: Jun. 10, 1986

[54] MULTI-POSITION SPRING LOADED TIMING CAM FOR SHEET RELEASE GRIPPERS

[75] Inventors: Koji Ishii; Kenso Maehara, both of Hiroshima, Japan

[73] Assignee: Ryobi Ltd., Hiroshima, Japan

[21] Appl. No.: 776,717

[22] Filed: Sep. 16, 1985

Related U.S. Application Data

[62] Division of Ser. No. 695,325, Jan. 28, 1985.

[30] Foreign Application Priority Data

Jan. 30, 1984 [JP] Japan ..... 59-12583[U]

[51] Int. Cl.[4] ..... B41F 1/30

[52] U.S. Cl. ..... 101/409; 271/82

[58] Field of Search ..... 101/76, 408, 409, 410, 101/415.1, 232, 246; 271/314, 82

[56] References Cited

U.S. PATENT DOCUMENTS

| | | | |
|---|---|---|---|
| 2,348,073 | 5/1944 | Lake et al. | 101/409 |
| 2,371,525 | 3/1945 | Kibler | 101/409 |
| 3,221,652 | 12/1965 | Mestre | 101/409 |
| 4,384,526 | 5/1983 | Korteweg | 101/409 |
| 4,459,913 | 7/1984 | Kowalik | 101/415.1 |
| 4,538,513 | 9/1985 | Sedlak et al. | 101/76 |

*Primary Examiner*—E. H. Eickholt

*Attorney, Agent, or Firm*—Sughrue, Mion, Zinn, Macpeak & Seas

[57] ABSTRACT

A numbering device for an offset printing press including a slide mechanism. The slide mechanism includes a pair of slide plates fixed to frames of the numbering device and two pairs of rollers fixed to frames of the main machine, wherein the slide plates are received between respective pairs of the guide rollers such that the numbering device can be slid towards and away from the main machine. A first gear is mounted on a drive shaft of the main machine, while a second gear is mounted on a numbering impression cylinder of the numbering device. The two gears are engaged when the numbering device is slid towards the main machine and disengaged for the opposite direction of movement of the numbering device. A detent mechanism is provided for fixing the numbering device in either the engaged or disengaged positions of the gears.

4 Claims, 9 Drawing Figures

MULTI-POSITION SPRING LOADED TIMING CAM FOR SHEET RELEASE GRIPPERS

This is a division of application Ser. No. 695,325, filed Jan. 28, 1985.

BACKGROUND OF THE INVENTION

The present invention relates to a slide mechanism in a numbering device for an offset press.

In an offset press, a numbering device may or may not be used dependent on whether numbers are to be printed or not. However, the conventional numbering device cannot readily be attached to and detached from the offset press (hereinafter referred to as the "main machine"). Thus, it is highly troublesome to change between operations where numbers are printed and numbers are not printed. Moreover, when the numbering device is not in use, paper is still passed therethrough and the numbering device is still required to be driven, imposing a large load on the main machine and accelerating wear of the numbering device.

Further, small-size offset presses are generally constructed so as to pass sheets longitudinally therethrough. When printing numbers on trailing ends of sheets with a numbering device subsequent to an ordinary printing operations, sheets tend to be displaced or slackened since they are gripped only when they reach a position where numbering and numbering impression cylinders of the numbering device contact each other at their peripheries. With such an arrangement, the printed numbers on the trailing ends of the sheets are liable to be out of precise alignment with each other. The sheets are therefore required to be held down by brush rollers or the like. However, such a sheet holder arrangement fails to be fully effective.

FIG. 1A of the accompanying drawings illustrates a cylinder arrangement proposed to solve the above problems. In FIG. 1A, a gripper (not shown) is mounted on a numbering impression cylinder b held in peripheral contact with a numbering cylinder a for discharging sheets directly from the numbering impression cylinder b. With such a cylinder arrangement, the gripper is opened at a point c on the numbering impression cylinder b to discharge sheets d, whereupon the sheets d are released. Therefore, the trailing ends of the sheets cannot be prevented from being displaced.

SUMMARY OF THE INVENTION

As a result of studies conducted to find ways to overcome the above difficulties, the present invention has been conceived, which provides a novel slide mechanism in a numbering device.

Specifically, it is an object of the present invention to provide a numbering device which can be easily attached to and detached from a main machine as required.

In accordance with the above and other objects, there is provided a slide mechanism in a numbering device for an offset printing press, which numbering device is provided independently of a main machine and is disposed rearwardly of a paper discharger of the main machine. The numbering device is provided with a pair of slide plates fixed to respective frames of the numbering device. The main machine is provided with two pairs of guide rollers, between which are received respective ones of the slide plates such that the numbering machine is slidable back and forth with respect to the main machine. The main machine has a drive shaft with a first gear mounted thereon while a numbering impression cylinder of the numbering device has a second gear mounted thereon. The first and second gears are positioned so that they can be brought into and out of mesh as the numbering device is slided towards and away from the main machine. The frames of the main machine and numbering device have locking holes corresponding to positions where the first and second gears mesh with each other and where they are out of mesh with each other. A locking pin is provided to selectively lock the two sets of holes so that the numbering device can be held at either the position where the first and second gears are engaged or the position where the first and second gears are out of engagement.

The present invention may further be practiced by providing a sheet delivery cylinder in addition to a numbering cylinder and a numbering impression cylinder, the sheet delivery cylinder being held in peripheral contact with the numbering impression cylinder to produce an increased interval from a point of peripheral contact between the numbering and numbering impression cylinders to a point where sheets are released from a gripper on the sheet delivery cylinder, the interval being greater than a maximum sheet dimension so that a sheet can be gripped by the gripper until a numbering head moves past the trailing end of the sheet, thereby preventing the sheet from flexing or being displaced to achieve an increased accuracy of printing numbers on the trailing ends of sheets.

Further in accordance with the present invention, there is provided a sheet delivery cam for opening and closing a gripper, the sheet delivery cam being switchable between two positions to change the timing to release a sheet from the gripper for thereby optimizing sheet transfer no matter whether the numbering device is used or not, and also to allow the sheet delivery cam to be switched in an easy operation simply and in a short period of time without using any tools.

DESCRIPTION OF THE PREFERRED EMBODIMENTS

The present invention will be described in detail with reference to preferred embodiments.

Figure 2:
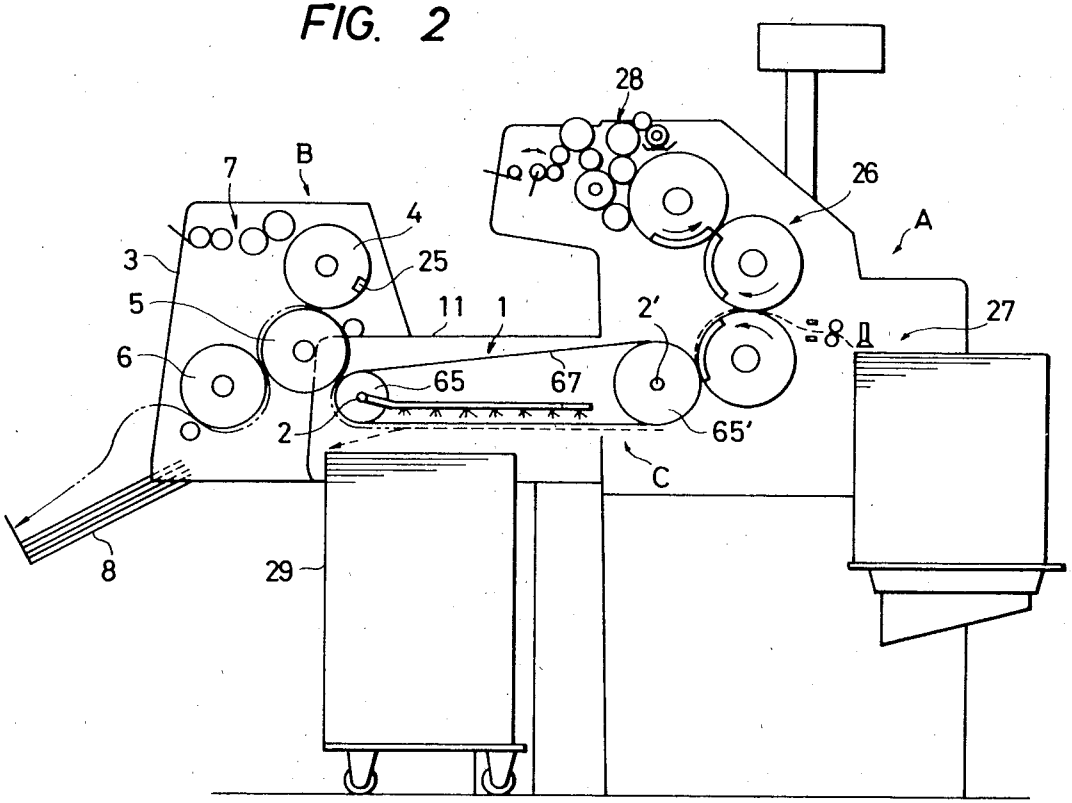
FIG. 2 is a side elevational view of a main machine on which a numbering device having a slide mechanism according to the present invention is mounted for use.
Figure 3:
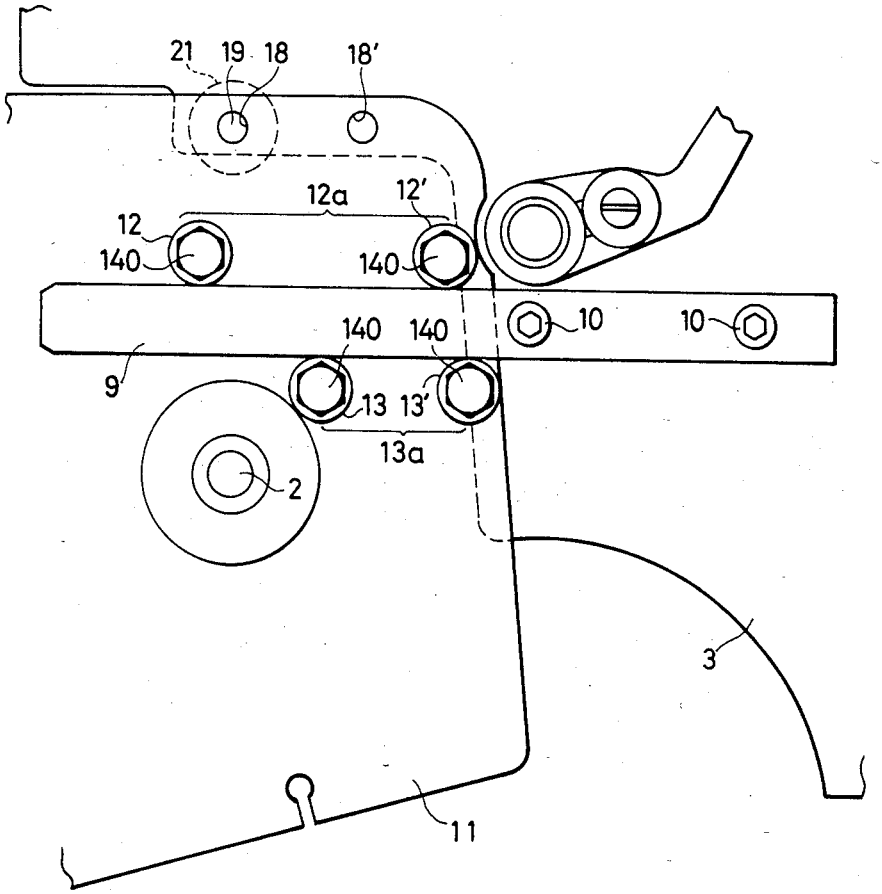
FIG. 3 is a side elevational view of the slide mechanism in the numbering device.

FIG. 2 is a schematic side elevational view of a numbering device B mounted on a main machine A. As shown, the numbering device B is located behind a paper discharger C in the main machine A. When numbers are to be printed, the numbering device B receives sheets printed by the main machine A from the paper discharger C. The numbering device B is driven by a drive shaft 2 of a paper discharging conveyor 1 in the paper discharger C.

As illustrated in FIGS. 2 through 5, the numbering device B is composed of numbering frames 3, a numbering cylinder 4, a numbering impression cylinder 5, a sheet delivery cylinder 6, an inking device 7, a sheet tray 8, and other components, the numbering device B being independent from the main machine A.

Slide plates 9, which are elongated in a back-and-forth direction, are fixed by bolts 10 to the numbering frames 3, and extend horizontally toward the main machine A. Guide rollers 12, 12', 13 and 13' are rotatably mounted by studs 140 on main machine frames 11 adjacent to the slide plates 9 and spaced at suitable intervals in the back-and-forth direction. The guide rollers 12, 12', 13 and 13' are grouped into an upper roller row 12*a* and a lower roller row 13*a*. Between the upper and lower roller rows 12*a* and 13*a*, the slide plates 9 are held in engagement for allowing the numbering device B to slide back and forth in directions toward and away from the main machine A, and also for permitting the number device B to be easily detached and attached.

Gears 14 and 15 of identical gear tooth pitch are fixed to the drive shaft 2 in the paper discharger C and the numbering impression cylinder 5, respectively. A disk 16, fixed to the drive shaft 2, has two radial recesses 16*a* defined in a peripheral portion thereof. The numbering impression cylinder 5 has a block 17 projecting radially outwardly for retractably engaging in one of the recesses 16*a* at a time. The gear 15 can be moved out of mesh with the gear 14 by sliding the numbering device B in the longitudinal direction. The numbering impression cylinder 5 has a gripper (not shown) which operates at a predetermined timing to be closed and opened at a prescribed position for gripping and releasing a sheet of paper. The recesses 16*a* and the block 17 are relatively positioned such that the block 17 will fit in one of the recesses 16*a* in the prescribed position. The gears 14 and 15 can mesh with each other only in the postion in which the block 17 is fitted in the recess 16*a*, and cannot mesh with each other at any other positions.

Figure 5:
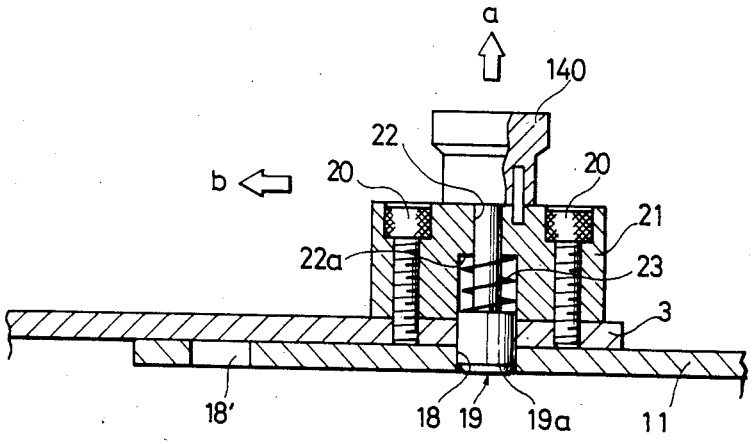
FIG. 5 is a sectional plan view showing the relationship between locking holes and a locking pin in the slide mechanism.

When the gears 14 and 15 are in mesh, the numbering frames 3 and the main machine frames 11 are partially overlapped as shown in FIG. 5. In the overlapped portions, each of the main machine frames 11 has two locking holes 18 and 18' positioned in locations corresponding respectively to a position in which the gears 14 mesh and a position in which they are out of mesh. Each of the numbering frames 3 has a locking pin 19 retractably engageable in one of the locking holes 18 and 18' and axially slidable but normally urged under a spring force in a direction to engage the locking holes.

As shown in FIG. 5, the locking pin 19 extends slidably through an attachment hole 22 defined in a holder 21 fixed to the numbering frame 3 by means of screws 20. The locking pin 19 is normally urged into engagement in the locking hole 18 or 18' by a compression spring 23 having ends seated on an annular seat 22*a* in the attachment hole 22 and a head 19*a* of the locking pin 19 and disposed around the locking pin 19. A knob 24 is secured to an end of the locking pin 19 projecting out of the attachment hole 22. By gripping the knob 24 and pulling the same in the direction of the arrow a against the resilient force of the spring 23, the locking pin 19 is retracted from the locking hole 18. Then, the knob 24 slides in the direction of the arrow b to move the numbering device B in the direction of the arrow b (rearwardly of the main machine A). The gears 14 and 15 are now brought out of mesh. By releasing the locking pin 19 when it is aligned with the other locking hole 18', the locking pin 19 is moved under the bias of the spring 23 into engagement in the locking hole 18'. The numbering device B is now separated from the main machine A. When the numbering device B is slid further in the direction of the arrow b without engaging in the locking hole 18', the numbering device B can be detached from the main machine A.

Denoted in FIG. 2 at 25 is a numbering head mounted on the numbering cylinder 4, 26 a printing section in the main machine A, 27*a* paper feeder, 28 an inking device, and 29 a sheet table.

When the numbering device B is to be attached to the main machine A, the slide plates 9 are inserted between the upper and lower roller rows 12*a* and 13*a* and pushed toward the main machine A to slide the numbering device B. In the position in which one of the recesses 16*a* in the disk 16 is aligned with the block 17, the gear 14 on the drive shaft 2 and the gear 15 on the numbering impression cylinder 5 are held in mesh. The locking pin 19 is positioned so that it is aligned with the locking hole 18 in the position in which the gears 14 and 15 mesh. Therefore, when sliding the numbering device B in the manner described above, the locking pin 19 should be pulled by the knob 24 against the force of the spring 23 out of engagement with the main machine frame 11. The locking pin 19 is then released when the gears 14 and 15 are brought into mesh. The locking pin 19 is not advanced under the spring force into the locking hole 18 as shown in FIG. 5, whereupon the numbering device b is positioned for use.

Figure 4:
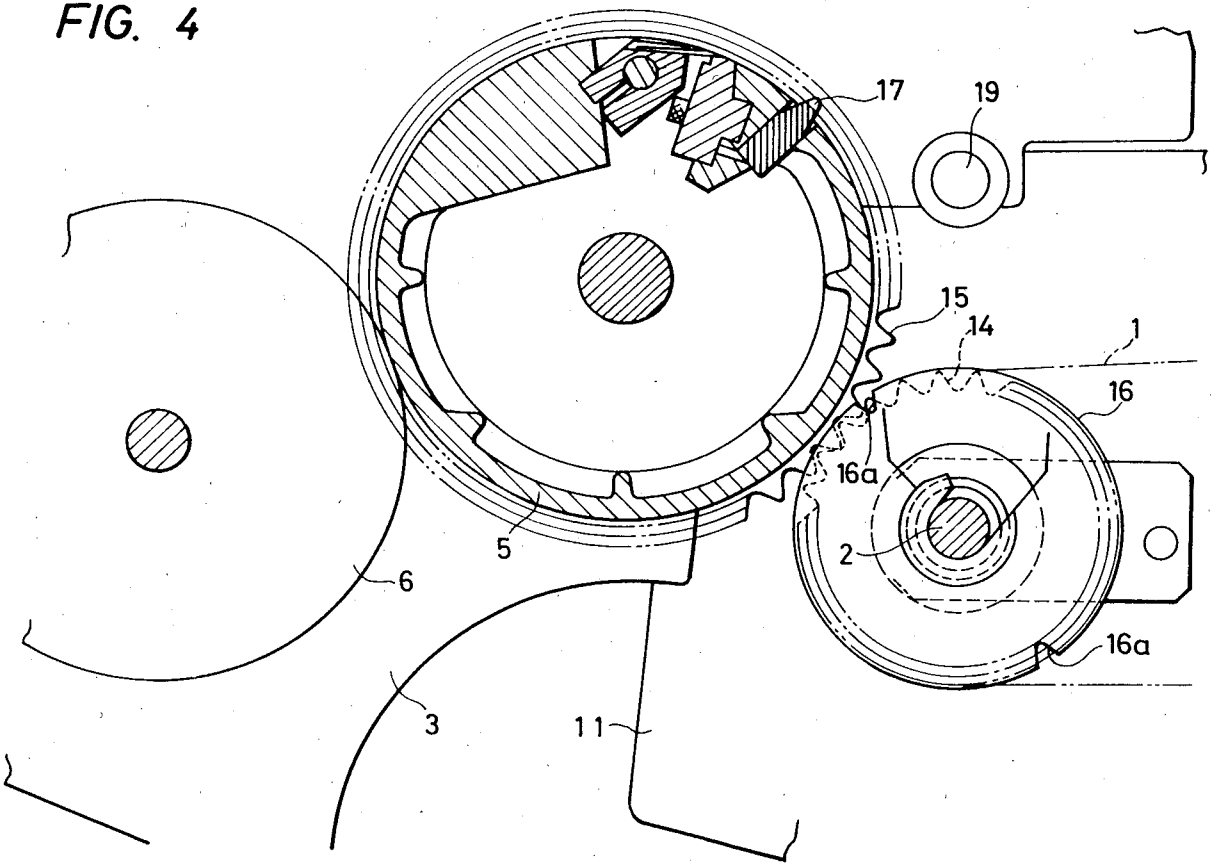
FIG. 4 is a sectional side elevational view of the slide mechanism in the numbering device.

When the locking pin 19 is retracted out of the locking hole 18 and the knob 24 is pulled in the direction away from the main machine A, the slide plate 9 is guided by the upper and lower roller rows 12*a* and 13*a* so as to slide in the direction of the arrow b in FIG. 4. The gears 14 and 15 are taken out of mesh. By bringing the locking pin 19 into engagement in the other locking hole 18', the numbering device B is set in the out-of-use position.

Since the locking pin 19 is spring-biased in a direction to engage in the locking holes 18 and 18', the numbering device B can reliably be held in the in-use and out-of-use positions.

When the locking pin 19 is retracted out of the locking hole 18 or 18' and pulled in the direction of the arrow b in FIG. 5, the slide plate 9 is disengaged from the upper and lower roller rows 12*a* and 13*a*. The numbering device B is now detached from the main machine A.

In the in-use position, sheets of paper are passed through the numbering device B where numbers are printed on the sheets. The sheets are then discharged onto the sheet tray 8 as indicated by the two-dot/dash line in FIG. 2. In the out-of-use position, sheets are discharged from the paper discharger C in the main machine A onto the sheet table 19 without passing through the numbering device B, as indicated by the broken line in FIG. 2.

The slide mechanism in the numbering device for the offset press operates in the manner described above to allow for attachment and detachment of the numbering device B to and from the main machine A as required. When the numbering device B is not to be used, the numbering device B is slid in a direction away from the main machine A and removed therefrom so that the main machine A can effect ordinary printing operations. Printed sheets can be discharged onto the sheet table 29 without passing through the numbering device B. Therefore, difficulties caused by passing the sheets through the numbering machine B are eliminated. Inasmuch as the numbering device B is held at rest in the out-of-use position, the load on the main machine A is reduced as well as the wear on the numbering device B. The numbering device B can easily be switched between the in-use and out-of-use positions simply by moving the locking holes 18 and 18' and sliding the numbering device B.

Figure 1A:
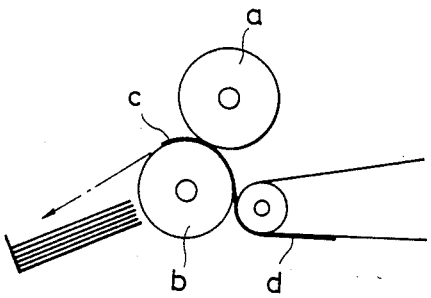
FIG. 1A PRIOR ART
FIG. 1A is a schematic view of a cylinder arrangement in a conventional numbering device.
Figure 1B:
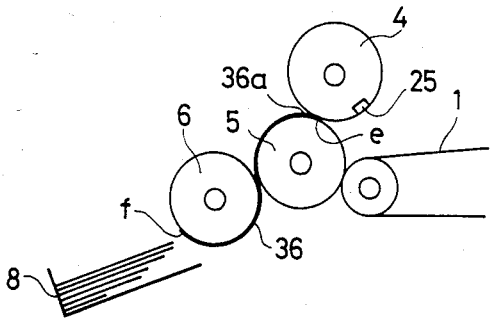
FIG. 1B is a side elevational view of a cylinder arrangement of the numbering device of the invention.

The cylinder arrangement of the numbering device of the invention will be further described with reference to FIG. 1B. As shown in FIG. 1B, the sheet delivery cylinder 6 having a gripper (not shown) is provided in addition to the numbering cylinder 4 and the numbering impression cylinder 5. The sheet delivery cylinder 6 is rotatably supported between the numbering frames 3 and held in peripheral contact with the numbering impression cylinder 5. An interval from a point e of peripheral contact between the numbering cylinder 4 and the numbering impression cylinder 5 to a point f where a sheet 36 is released from the gripper on the sheet delivery cylinder 6 is selected to be larger than a maximum sheet dimension so that the sheet 36 can be gripped by the gripper on the sheet delivery cylinder 6 until the numbering head 25 on the numbering cylinder 4 moves past a trailing end 36*a* of the sheet 36.

The sheet 36 printed in the printing section 26 in the main machine is delivered by the paper discharging conveyor 1 to the numbering impression cylinder 5 in the numbering device. The sheet 36 is then gripped by a non-illustrated gripper on the numbering impression cylinder 5 and peripherally transferred. When the sheet 36 is thereafter released from the gripper on the numbering impression cylinder 5, the sheet 36 is gripped by the gripper on the sheet delivery cylinder 6 in timed relation to the release of the sheet from the cylinder 5 and then peripherally transferred. Thereafter, the sheet 36 is released in the vicinity of the sheet tray 8 or at the release point f and discharged onto the sheet tray 8. A number is printed on the trailing end 36*a* of the sheet 36 while the sheet 36 is gripped by the gripper on the sheet delivery cylinder 6 or before the sheet 36 is released from the gripper.

In the cylinder arrangement in the numbering device for the offset press according to the present invention constructed and operated as described above, the sheet 36, transferred from the paper discharging conveyor 1 in the main machine to the numbering impression cylinder 5 in the numbering device, is held against the sheet delivery cylinder 6 until the numbering head 25 moves past the trailing end 36*a* of the sheet 36, that is, until numbering is completed. Therefore, the sheet 36 is prevented from flexing or being displaced, and the accuracy of printing a number on the trailing end 36*a* is much higher than that achieved by conventional cylinder arrangement.

The present invention will be further described in detail with reference to the paper discharging conveyor 1, as shown in detail in FIGS. 6 through 8. The paper discharging conveyor 1 preferably takes the form of a chain delivery mechanism. The chain delivery mechanism, which is disposed between the main machine frames 11, includes a chain 67 trained around sprockets 65 and 65' mounted on shafts 2 and 2', rotatably supported in front and rear positions, respectively. The chain 67 has a gripper 66. When the shaft 2 is rotated by a drive source of the main machine A, the chain 67 is rotated to cause the gripper 66 to grip a leading end of a sheet printed by the printing section 26 in the main machine and transfer the sheet to a position over the sheet table 29 in the main machine A, in which position the gripper 66 is opened by a sheet delivery cam 41 on the shaft 2 to release and discharge the sheet.

Figure 8:
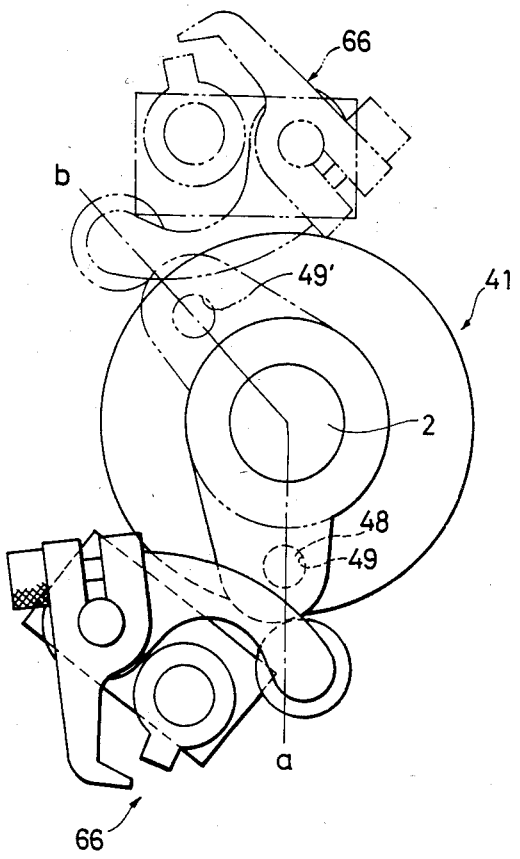
FIG. 8 is a view showing timing positions for releasing a sheet form a gripper in the cam changeover device.
Figure 6:
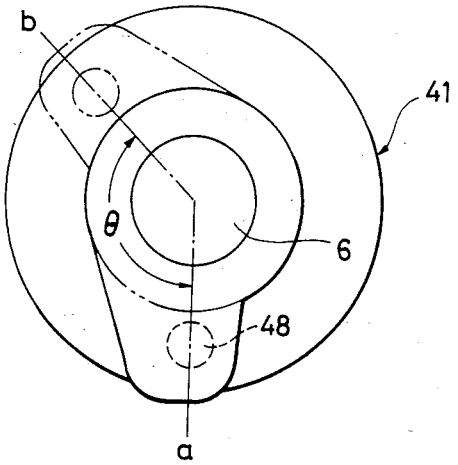
FIG. 6 is a front elevational view of a sheet delivery cam in the cam changeover device.
Figure 7:
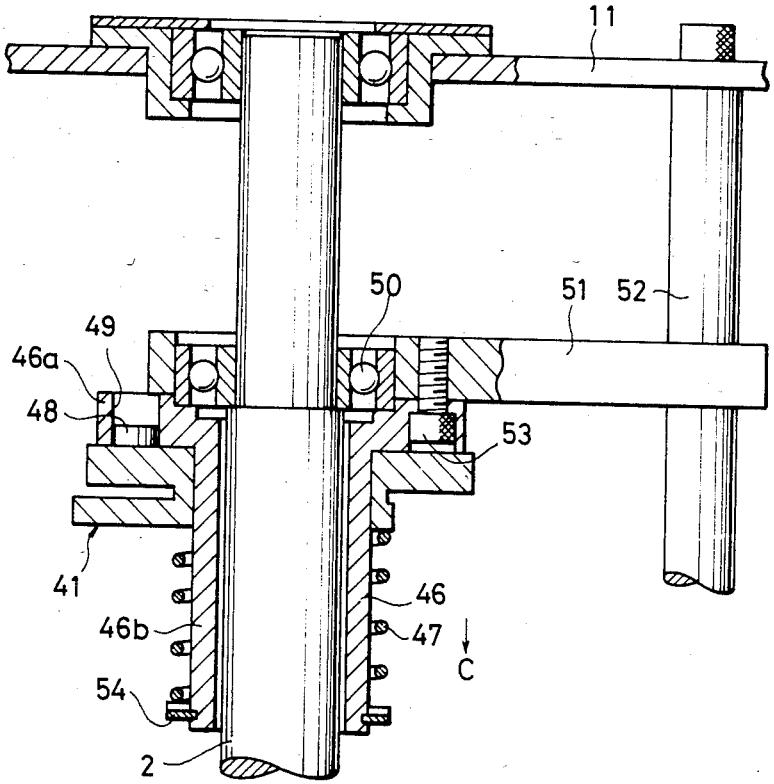
FIG. 7 is a sectional plan view of the cam changeover device.

As illustrated in FIGS. 6 through 8, a sheet delivery cam changeover device according to the present invention includes a tubular cam holder 46, having a flange 46*a* on one end thereof, nonrotatably and axially immovably fitted over the spocket shaft 2. The cam holder 46 has a cylindrical portion 46*b* over which the sheet delivery cam 41 is axially slidably and rotatably fitted. The sheet delivery cam 41 is resiliently pressed against the flange 46*a* under the force of a compression spring 47 disposed around the cylindrical portion 46*b*. The flange 46*a* and the sheet delivery cam 41 have on confronting surfaces thereof one projection 48 and two recesses 49 and 49' angularly spaced from each other by an angle $\theta$ in the circumferential direction. The projection 48 is selectively engageable in the recesses 49 and 49' for allowing the sheet delivery cam 41 to be switched between positions a and b shown in FIG. 6 to thereby change the timing at which a sheet is released from the gripper 66.

More specifically, the timing of transferring the sheet from the chain delivery mechanism onto the sheet table 29 in the main machine A is different from that of transferring the sheet from the chain delivery mechanism to the numbering device B. By effecting changeover of the sheet delivery cam 41 between the two positions, the timing at which the sheet is released from the gripper 66 can be varied to meet the transfer of the sheet onto the sheet table 29 and the transfer of the sheet to the numbering device B.

In FIGS. 6 through 8, when the sheet delivery cam 41 is in the position a indicated by the solid lines, the gripper 66 is opened in the position a as shown by the solid lines to transfer the sheet to the sheet table 29. When the sheet delivery cam 41 is in the position b indicated by the two-dot/dash lines, the gripper 66 is opened in the position b to transfer the sheet to the numbering device B. The sheet delivery cam 41 is angularly movable through a predetermined changeover angle (between the positions a and b) to effect the above operation.

The changeover angle for the sheet delivery cam 41 is determined by the angle $\theta$ between the two recesses 49 and 49' in which the projection 48 is selectively engageable. As illustrated, the projection 48 is disposed on the sheet delivery cam 41 and the recesses 49 and 49' are defined in the cam holder 46. Alternately the projection 48 and the recesses 49 and 49' may be exchanged in positions.

The cam holder 46 is fixed by bolts 53 to a holder 51 mounted by a bearing 50 on the sprocket shaft 2 and having one end secured to a stay 52 supported between the main machine frames 11.

The compression spring 47 has one end supported on a spring seat 54 fixed to the cylindrical portion 46*b* of the cam holder 46 and an opposite end held in abutment against the sheet delivery cam 41 for urging the latter against the flange 46*a* of the cam holder 46.

The sheet delivery cam 41 can be changed in angular position by sliding the same axially in the direction of the arrow C in FIG. 7 against the force of the spring 47 to bring the projection 48 out of engagement with the recess 49 or 49', turning the sheet delivery cam 41 around its axis, and then releasing the sheet delivery cam 41 of the force applied in the direction of the arrow C, whereupon the sheet delivery cam 41 returns axially to the initial position to bring the projection 48 into engagement with the desired recess.

With the sheet delivery cam changeover device for the chain delivery mechanism for the printing machine constructed as described above, the sheet delivery cam 41 can be angularly displaced as desired to change the timing of releasing the sheet from the gripper 66 to meet the requirements of transfer of the sheet onto the sheet table 29 or the transfer thereof into the numbering device B. When the numbering device B is not in use, the sheet can be dropped directly from the chain delivery mechanism onto the sheet table 29, thus eliminating the problems which are caused in the conventional arrangement by passing the sheet through the numbering device B. The sheet delivery cam 41 can be changed over without using tools and by employing only a simple operation of turning the cam 41. Structurally, the cam holder 46 is nonrotatably and axially immovably mounted on the sprocket shaft 2, and the sheet delivery cam 41 is rotatably and axially slidably fitted over the cam holder 46 and is axially urged under spring forces. Since the overall construction is simple, this apparatus can be manufactured inexpensively. Furthermore, the cam device has no danger of being operated in error.

We claim:

1. A sheet delivery mechanism for an offset printing press, comprising: a sprocket shaft, a cam holder nonrotatably and axially immovably disposed over said sprocket shaft, a gripper, a sheet delivery cam rotatably and axially movably fitted on said cam holder for opening and closing said gripper, and means for providing a spring force to urge said sheet delivery cam against a flange of said cam holder, said sheet delivery cam and said cam holder flange together defining a single projection and plural recesses angularly spaced by a predetermined angle, said projection being selectively engageable in said recesses to determine a timing of releasing a sheet from said gripper.

2. An apparatus as claimed in claim 1, wherein said means for providing a spring force comprises a coil spring fitted around said cam holder and engaging a radially inner portion of said sheet delivery cam.

3. An apparatus as claimed in claim 1, wherein said projection is formed on said sheet delivery cam and said recesses are provided in said flange of said cam holder.

4. An apparatus as claimed in claim 1, wherein said predetermined angle comprises a cam rotation angle, such that a rotational phase of said cam is varied by selectively engaging said projection in said recesses.

* * * * *